US008176592B1

(12) United States Patent
Carpenter et al.

(10) Patent No.: US 8,176,592 B1
(45) Date of Patent: May 15, 2012

(54) METHODS AND APPARATUS FOR REMOVING PAINT FROM A BARREL OF A PAINTBALL GUN

(75) Inventors: Dale Carpenter, Gilbert, AZ (US); Greg Clawson, Mesa, AZ (US); Travis Dusek, Tempe, AZ (US)

(73) Assignee: Dale Carpenter, Gilbert, AZ (US)

( * ) Notice: Subject to any disclaimer, the term of this patent is extended or adjusted under 35 U.S.C. 154(b) by 0 days.

(21) Appl. No.: 12/983,577

(22) Filed: Jan. 3, 2011

Related U.S. Application Data

(60) Provisional application No. 61/292,985, filed on Jan. 7, 2010.

(51) Int. Cl.
*F41A 29/02* (2006.01)
*B08B 9/02* (2006.01)

(52) U.S. Cl. ..... 15/104.165; 15/104.16; 42/95

(58) Field of Classification Search ..... 15/104.05, 15/104.16, 104.165; 42/95
See application file for complete search history.

(56) References Cited

U.S. PATENT DOCUMENTS

| | | | | |
|---|---|---|---|---|
| 3,856,024 | A * | 12/1974 | Lamberti | 131/243 |
| 4,895,221 | A * | 1/1990 | Carlson | 184/15.1 |
| 5,171,925 | A * | 12/1992 | Mekler | 42/95 |
| 5,972,125 | A * | 10/1999 | Hedge | 134/8 |
| 6,058,547 | A * | 5/2000 | Foster | 15/104.12 |
| 6,088,866 | A * | 7/2000 | Hedge | 15/104.16 |
| 6,701,658 | B1 * | 3/2004 | Brownell | 42/95 |
| 6,868,575 | B2 * | 3/2005 | Koregelos | 15/104.04 |
| 6,920,662 | B2 * | 7/2005 | Moore | 15/104.2 |
| 7,055,279 | B2 * | 6/2006 | Flores | 42/95 |
| 7,367,151 | B1 * | 5/2008 | Black et al. | 42/95 |
| 7,377,003 | B1 | 5/2008 | Dochterman | |
| 7,386,912 | B2 * | 6/2008 | Horton | 15/165 |
| 7,886,399 | B2 * | 2/2011 | Dayton et al. | 15/236.04 |
| 7,979,943 | B2 * | 7/2011 | Arai et al. | 15/104.05 |
| 2006/0185658 | A1 | 8/2006 | Stevens | |
| 2009/0114694 | A1 | 5/2009 | Lemanski | |
| 2011/0047853 | A1 * | 3/2011 | Williams | 42/95 |
| 2011/0099880 | A1 * | 5/2011 | Stephens et al. | 42/95 |

* cited by examiner

*Primary Examiner* — Mark Spisich
*Assistant Examiner* — Michael Jennings
(74) *Attorney, Agent, or Firm* — Letham Law Firm LLC; Lawrence Letham

(57) ABSTRACT

An apparatus for removing paint from a barrel of a paintball gun.

20 Claims, 7 Drawing Sheets

METHODS AND APPARATUS FOR REMOVING PAINT FROM A BARREL OF A PAINTBALL GUN

CROSS-REFERENCE TO RELATED APPLICATIONS

This application claims priority under 35 U.S.C. §119(e) from U.S. provisional patent application No. 61/292,985 by Carpenter filed Jan. 7, 2010 herein incorporated by reference.

FIELD OF THE INVENTION

Embodiments of the present invention relate to removing paint from a barrel of a paintball gun.

BACKGROUND OF THE INVENTION

A paintball gun receives and launches a paintball. A paintball comprises a spherical object having a sturdy outer shell and a hollow interior. The hollow interior is filled with paint (e.g., liquid, paste). A paintball gun launches the paintball toward a target. Upon contact with the target, the outer shell of the paintball breaks and permits the paint to escape from the paintball. The paint that is released generally transfers to the target.

Sometimes, the outer shell of a paintball breaks prior to exit from the paintball gun. When a paintball breaks inside a paintball gun, the paint from the interior of the paintball remains in the breech and/or the barrel of the paintball gun. Removing paint from the breech and/or the barrel of a paintball gun improves performance of the paintball gun.

Removing paint from a barrel of a paintball gun could benefit from an apparatus (e.g., squeegee, swab) having structures for extracting and storing paint from the inside of a paintball gun barrel for transport out of the barrel.

BRIEF DESCRIPTION OF THE DRAWING

Embodiments of the present invention are described with reference to the drawing, wherein like designations denote like elements, and.

DETAILED DESCRIPTION OF THE PREFERRED EMBODIMENTS

Figure 1:
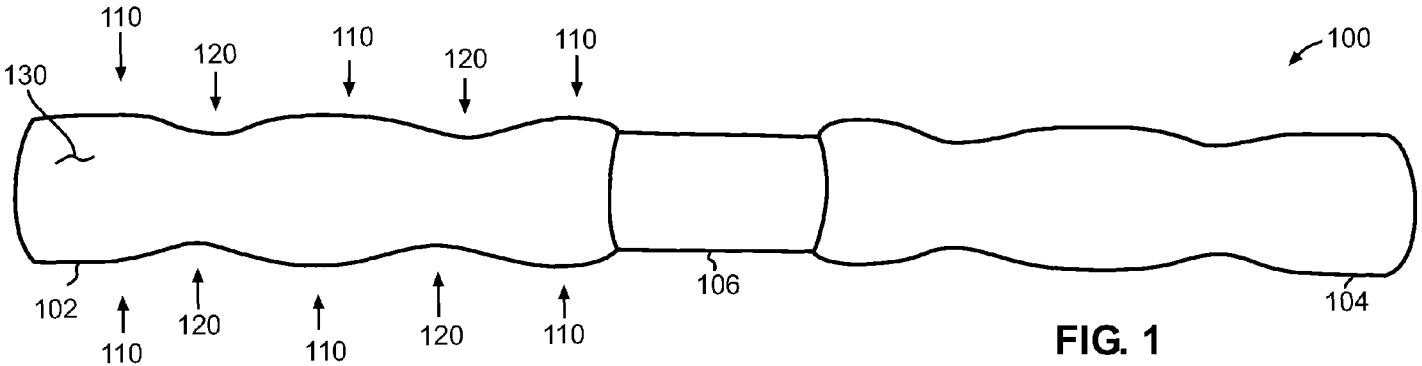
FIG. 1 is a side plan view of an implementation of an apparatus for removing paint from a barrel of a paintball gun according to various aspects of the present invention.

Referring to FIG. 1, apparatus 100 for removing paint from a barrel of a paintball gun may include, inter alia, cleaning portion 102, cleaning portion 104, and joining portion 106. Cleaning portion 102 and/or 104 may be inserted into the barrel of a paintball gun (not shown) to extract paint from the barrel. Cleaning portion 102 includes, inter alia, cover 130. Cover 130 may be formed of a conventional material that at least partially absorbs liquids (e.g., paint). Cover 103 may be positioned over structures that shape cover 130 to form ridges 110 and valleys 120.

A ridge may contact an inner portion of a barrel to remove (e.g., scrape, squeegee, push) paint from the inner surface of the barrel. As paint is removed from an inner surface of the barrel, paint may move to a valley of the apparatus. Paint may move from a ridge to a valley by twisting (e.g., turning, rotating) the apparatus. A valley may store (e.g., retain, hold, absorb, partially absorb) paint for removal (e.g., extraction) from the barrel when cleaning portion 102 is pulled (e.g., extracted, removed) from the barrel. An outer diameter (e.g., height) of a ridge may be approximately the same as an inner diameter of a barrel such that the ridge contacts the inner surface of the barrel to remove paint from the inner surface of the barrel. An outer diameter of a valley may be less than the outer diameter of a ridge to permit paint in the barrel to be retained (e.g., positioned, stored, held) in the valley for removal from the barrel as cleaning portion 102 is inserted into and/or removed from the barrel.

Factors that determine an amount of paint that may be removed from a barrel by cleaning portion 102 include, inter alia, a difference between the outer diameter of a ridge and a valley (e.g., depth of valley); absorptive properties of cover 130, spacing between ridges, widths of valleys, shapes of ridges and/or valleys (e.g., spiral, straight).

Cleaning portion 104 may operate to clean a barrel in a fashion similar to the operation of cleaning portion 102 as discussed above.

A ridge may be flexible (e.g., compressible, bendable) to form a close fit with an inside diameter of the barrel. A ridge may include, inter alia, a flexible material (e.g., rubber, silicon, plastic, cloth) in addition to and/or in place of cover 130 to form a close fit with the inside of a barrel to remove paint from an inner surface of the barrel. The locations of ridges and valley with respect to each other may facilitate the removal of paint from a barrel. Ridges and valleys may be positioned to form spiral patterns to remove paint from a barrel as cleaning portion 102 is turned (e.g., rotated) inside the barrel. A spiral pattern may facilitate transfer of paint from a ridge to a valley.

Joining portion 106 may adhere to and/or secure cover 130 at the mid portion of apparatus 100 using any conventional adhering or securing methods and/or structures. An end portion of cover 130 may be closed to cover the end portion of cleaning portion 102 and/or cover 130 may be adhered to and/or secured to the end portion of cleaning portion 102 using any conventional adhering and/or securing methods and/or structures.

Figure 2:
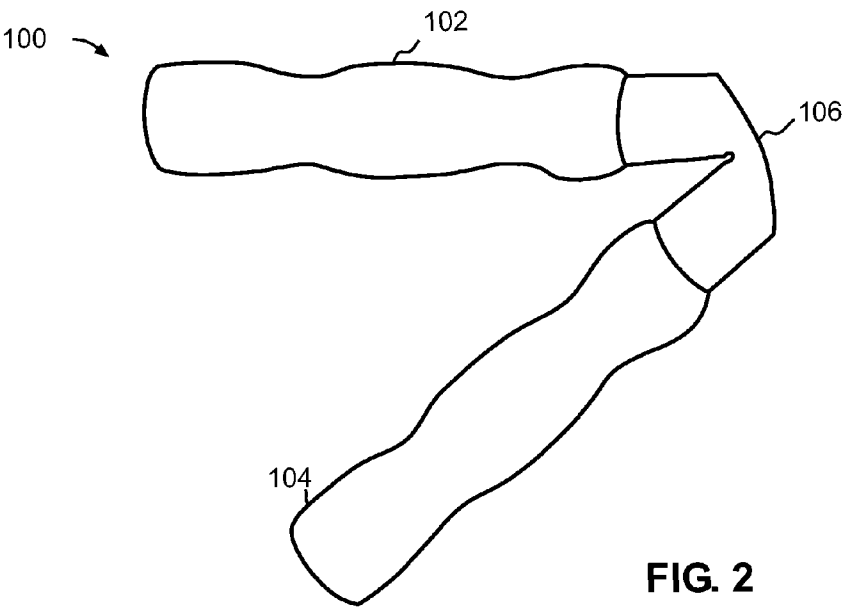
FIG. 2 is a side plan view of the apparatus of FIG. 1 bent at the mid-portion.
Figure 3:
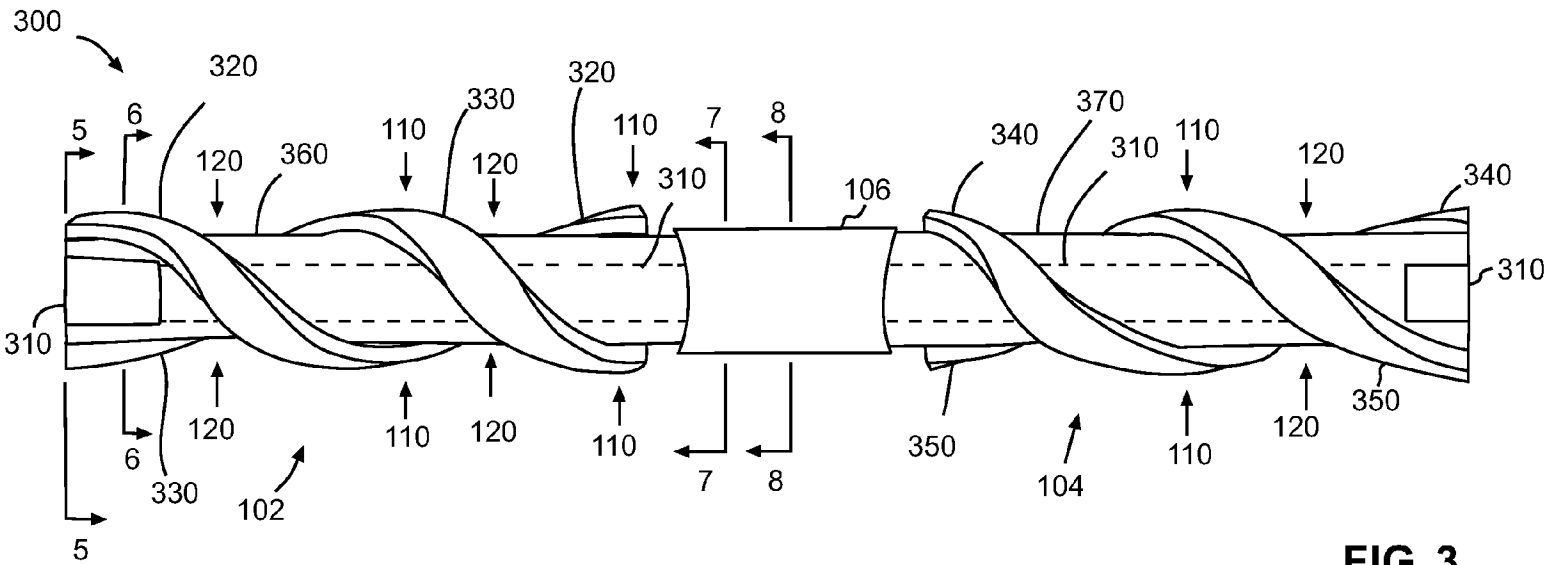
FIG. 3 is a side plan view of an implementation according to various aspects of the present invention of the apparatus of FIG. 1 without an absorptive cover.
Figure 4:
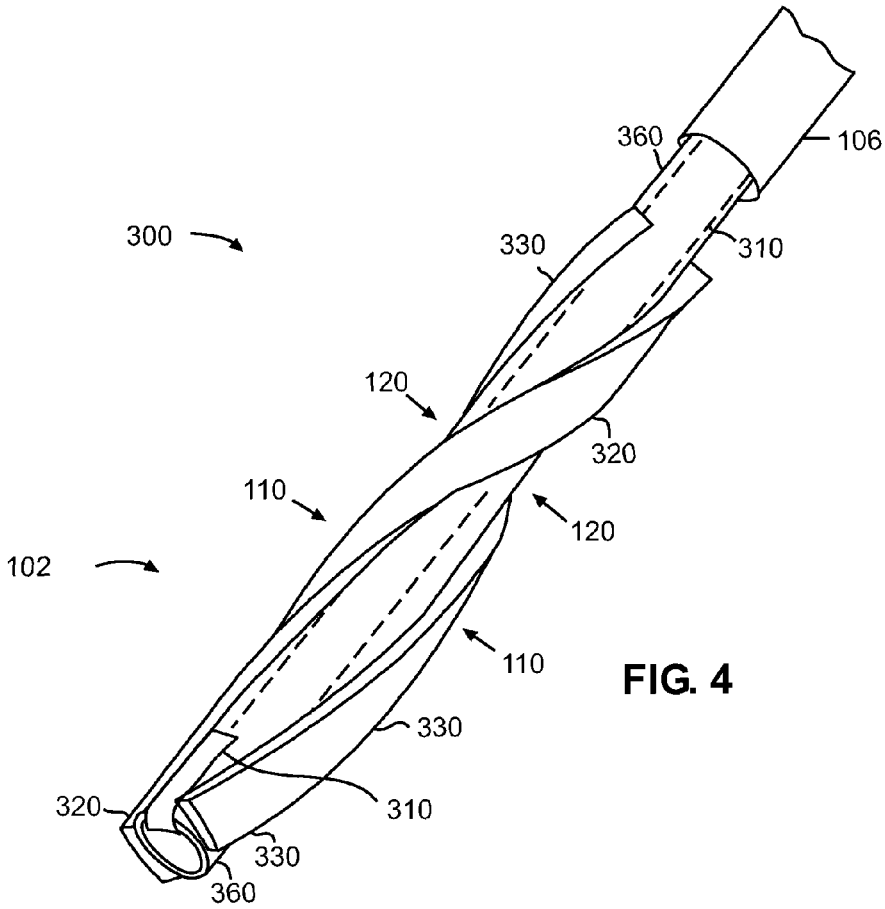
FIG. 4 is a partial perspective plan view of the implementation of FIG. 3.
Figure 5:
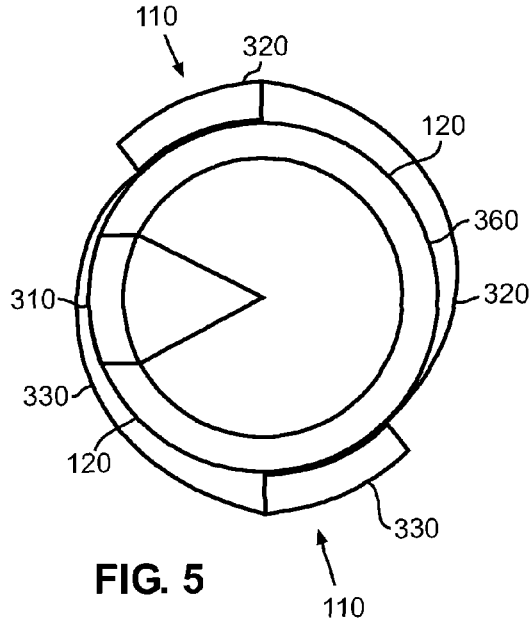
FIG. 5 is a end plan view of the implementation of FIG. 3.
Figure 6:
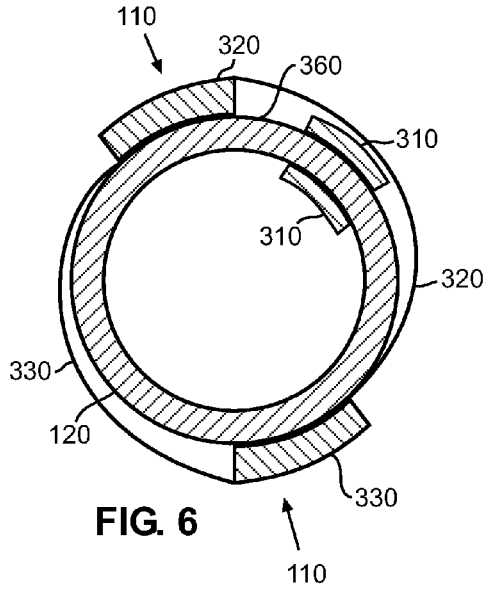
FIG. 6 is a cross-section view of the implementation of FIG. 3.
Figure 7:
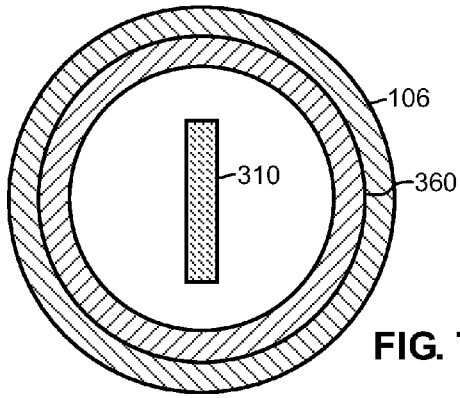
FIG. 7 is a cross-section view of the implementation of FIG. 3.
Figure 8:
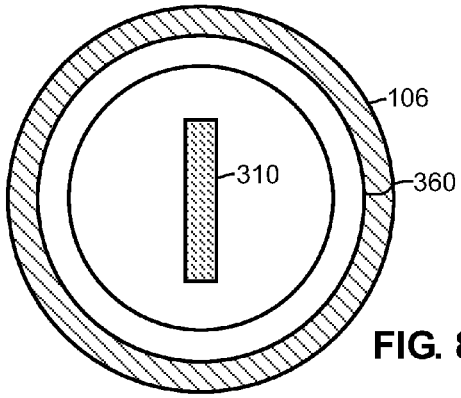
FIG. 8 is a cross-section view of the implementation of FIG. 3.
Figure 9:
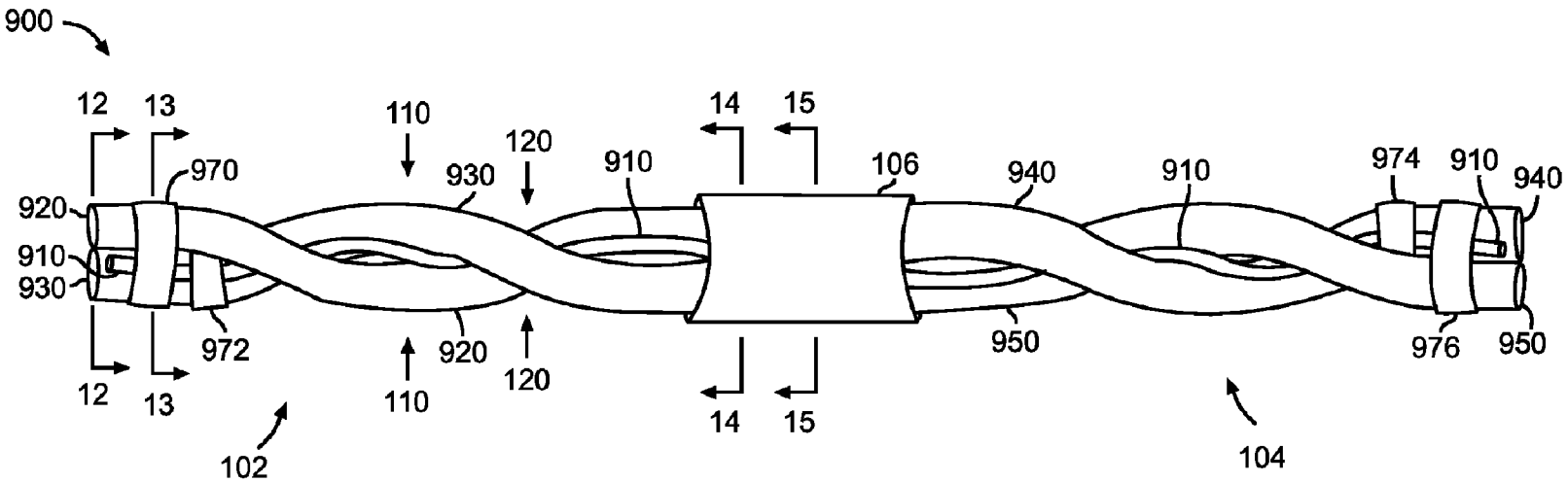
FIG. 9 is a side plan view of another implementation according to various aspects of the present invention of the apparatus of FIG. 1 without the absorptive cover.
Figure 10:
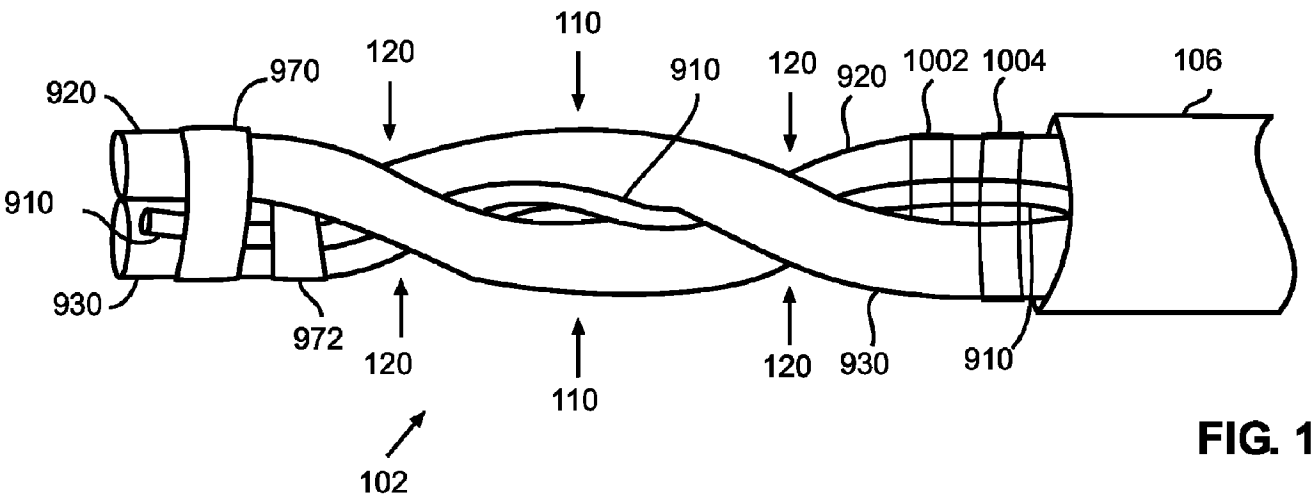
FIG. 10 is a partial side plan view of the implementation of FIG. 9.
Figure 11:
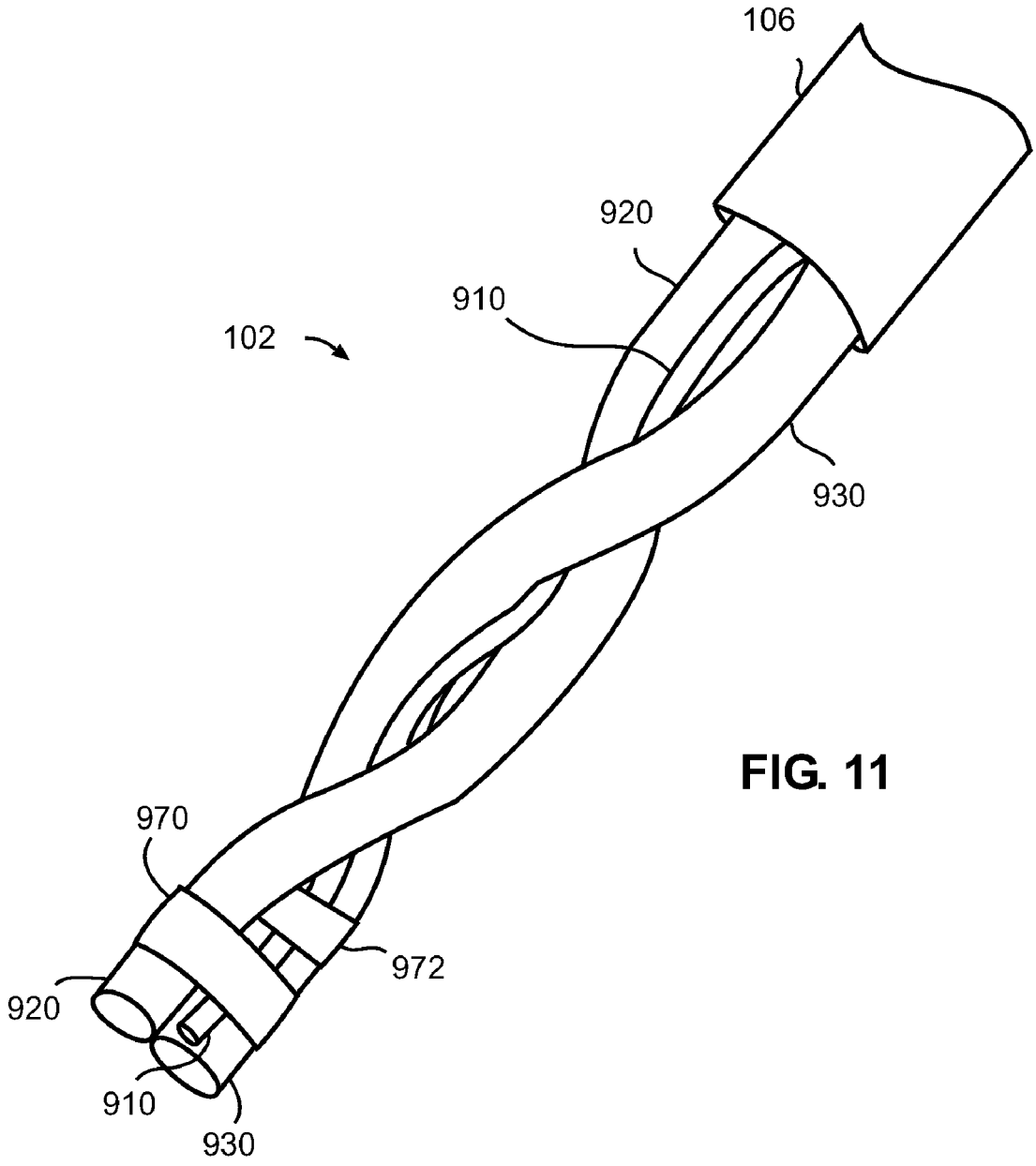
FIG. 11 is a partial perspective plan view of the implementation of FIG. 9.
Figure 12:
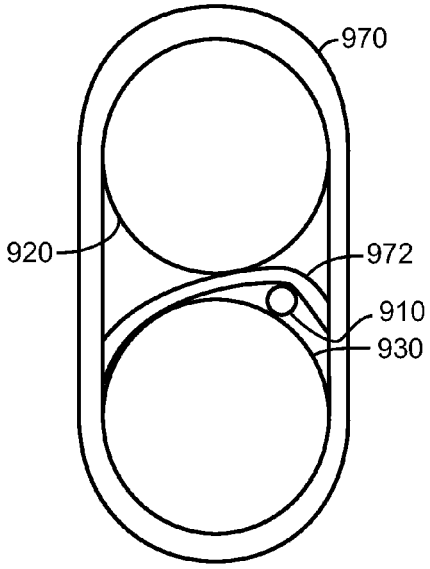
FIG. 12 is a end plan view of the implementation of FIG. 9.
Figure 13:
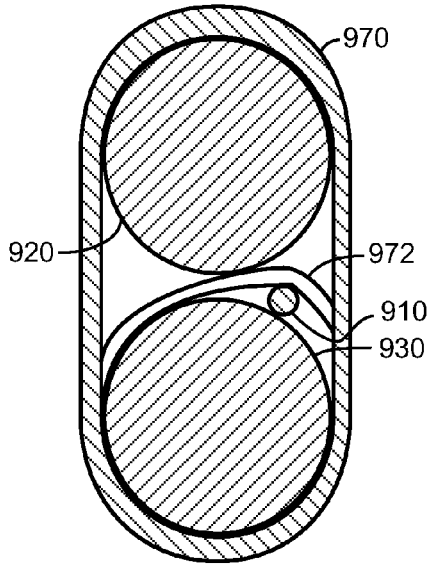
FIG. 13 is a cross-section view of the implementation of FIG. 9.
Figure 14:
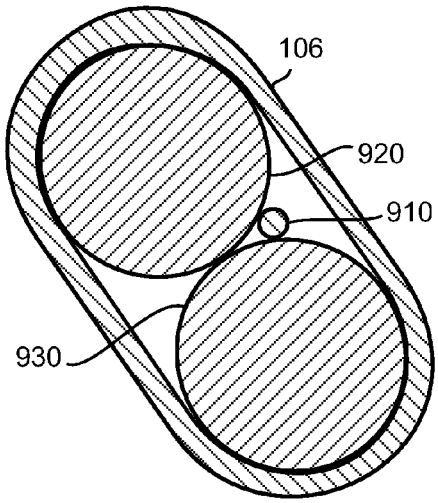
FIG. 14 is a cross-section view of the implementation of FIG. 9.
Figure 15:
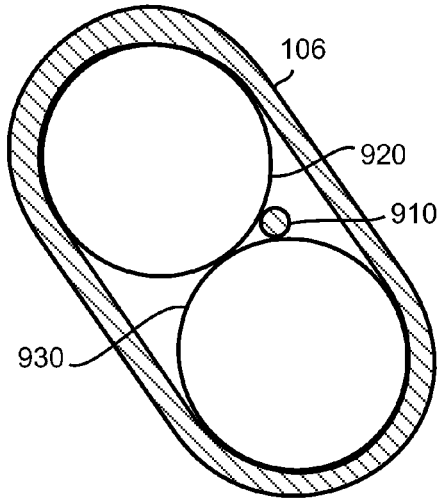
FIG. 15 is a cross-section view of the implementation of FIG. 9.

Joining portion 106 may be flexible or semi-flexible to permit apparatus 100 to be folded in half as shown in FIG. 2 for ease of transport. Joining portion 106 may operate as a handle for manipulating cleaning portion 102 and/or cleaning portion 104. Joining portion 106 may provide a grip for a user of apparatus 100 to hold.

Joining portion 106, cleaning portion 102, and cleaning portion 104 may be mechanically coupled together for form a cleaning apparatus. Joining portion 106 may mechanically couple a proximate end of cleaning portion 102 and cleaning portion 104 respectively. Joining portion 106 comprises any conventional coupling device (e.g., joint, threaded joint, clamp, bayonet, tape, glue).

In one implementation, joining portion 106 is formed of a semi-flexible hollow plastic tubing. Each end of the tubing mechanically couples to cover 130 and cleaning portions 102 and 104. The tubing bends to permit cleaning portion 102 to be positioned substantially next to cleaning portion 104.

A strap (e.g., ribbon, wire) may mechanically couple a distal end of cleaning portion 102 and/or cleaning portion 104 to joining portion 106. A strap may exert a force applied to joining portion 106 or cleaning portion 104 to the distal end of cleaning portion 102 to extract cleaning portion 102 from a barrel. A strap may be further used to pull cleaning portion 104 from a barrel.

Cover 130 may be formed of any conventional material suitable for removing paint from a surface. Cover 130 may be formed of a washable material to permit paint to be washed from cover 130. Removal of paint from cover 130 may permit apparatus 100 to be reused multiple times to remove paint from barrels.

Cleaning portion 104 may be the same as cleaning portion 102. Cleaning portion 104 may be separate from cleaning portion 102 and joined to cleaning portion 102 by joining portion 106.

Cleaning portion 102 or 104 may be used as a handle to turn apparatus 100 while cleaning portion 104 or 102 respectively is inserted into a barrel. Cleaning portion 102 or 104 may be used as a handle to extract (e.g., pull, remove) cleaning portion 104 or 102 respectively from a barrel.

Apparatus 100 may include, inter alia, any structures to form ridges and valleys and to enable portion 102 and/or portion 104 to operate as handles to extract apparatus 100 from a barrel.

In one implementation, structure 300 is positioned at least partially under cover 130. Cleaning portion 104 may be the same as and separate from cleaning portion 102.

Tube 360 (e.g., core, rod) forms the base of cleaning portion 102. Tube 370 forms the base of cleaning portion 104. Joining portion 106 couples tube 360 to tube 370. Ribbon 310 couples to an end portion of tube 360, extends through an interior hollow length of tube 360, extends through joining portion 106 (e.g., along side, through hollow interior), extends through an interior hollow length of tube 370, and couples to an end portion of tube 370. Ribbon 310 and joining portion 106 may couple to tube 360 and/or tube 370 in any conventional manner. Joining portion 106 couples portion 102 to portion 104 so that a pulling force on portion 102 or 104 does not pull portion 102 and/or 104 from joining portion 106 or separate portion 102 from 104. Ribbon 310 further joins portion 102, portion 104, and portion 106 so that a pulling force may be applied to portion 102, 104, and/or 106 without separating portion 102, 104, and/or 106 from each other. Joining portion 106 and ribbon 310 permit portion 102 and/or 104 to operate as handles to extract structure 300 from a barrel without separating portions 102, 104, and/or 106 from each other.

Outer diameter of tube 360 and tube 370 form the outer diameter of valleys 120, as discussed above, excluding the thickness of cover 130.

A ridge may mechanically couple to a tube.

Tape 320 (e.g., masking, duct, electrical, foam, freezer, door jam) and/or tape 330 are positioned on tube 360 to form ridges 110 on portion 102. Tape 340 and tape 350 are positioned on tube 370 to form ridges 110 on portion 104. A thickness of tape 320-350 determines the outer diameter of ridge 110. Tape 320-350 may comprise one or more layers of a tape having a lesser thickness to form a thicker structure to increase an outer diameter of ridge 110. Tape 320, and likewise tape 330-350, may be positioned in any manner relative to tube 360 and tape 330. In one implementation, tape 320 and tape 330 are parallel to a length of tube 360. In another implementation, as shown in FIGS. 3-6, tape 320 is positioned around tube 360 to form a spiral pattern (e.g., shape, form) with respect to the length of tube 360. Tape 330 is positioned parallel to tape 320 to form a second spiral around the length of tube 360. Tape 340 and 350 are positioned around tube 370 to form spirals around tube 370.

Valley 120 forms between tape 320 and 330. Valley 120 has the same shape (e.g., shape, spiral) and the ridges that form valley 120.

Ridges formed in a spiral shape helps the valleys to transport paint out of a barrel as the cleaning portion 102 or 104 is inserted into and rotated in a barrel.

Tape 320-350 couple to tubes 360 and 370 respectively in any conventional manner. In one implementation, tape 320-350 are glued to tubes 360 and 370 respectively.

Using compressible foam tape forms compressible ridges that may establish a closer (e.g., tighter) fit with the inner diameter of a barrel to improve removal of paint from the inner surface of the barrel. A compressible (e.g., flexible) ridge may enable an apparatus to clean barrels of different diameters.

In another implementation, apparatus 100 includes, inter alia, structures 900 to form ridges and valleys and to enable portion 102 and/or portion 104 to operate as handles to extract apparatus 100 from a barrel. Structure 900 may be positioned at least partially under cover 130. Cleaning portion 104 may be the same as and separate from cleaning portion 102.

Cleaning portion 102 includes, inter alia, rod 920 and rod 930. Cleaning portion 104 includes, inter alia, rod 940 and 950. Rods 920 and 930 are twisted with respect to each other. Rod 920 and 930 are secured together at one end portion by band 970 and at the end portion by band 1004 and/or joining portion 106. Securing rods 920 and 930 to each other at each end portion retains rods 920 and 930 in a twisted (e.g., spiral) combination. Rods 940 and 950 are twisted and retained together in a similar manner.

Twisting rod 920 with respect to rod 930 forms spiral ridges 110 and valleys 120 as discussed above. A ridge forms along each rod where the outer diameter of the combination is about the sum of the diameters of the rods. A valley forms along each rod where the outer diameter of the combination is less than the sum of the diameters of the rods. The depth of a valley, which is the different between the outer diameter of a ridge and the outer diameter of a valley, as discussed above, is about half the diameter of any one rod 920-950 because the rods contact each other at about the half way point of each rod. The width of a valley may be increased by positioning one rod a distance away from the other rod. A spacer may be positioned between the rods to position one rod a distance away from the other rod.

Rod 940 and 950 are twisted with respect to each other to form spiral ridges 110 and valleys 120 as discussed above.

Combination 900 further includes, inter alia, wire 910 that extends from an end portion of rod 920/930 through joining portion 106 to an end portion of rods 940/950. Wire 910 is secured to rod 920 and/or rod 930 using band 972 and to rod 940 and/or rod 950 using band 974. Wire 910 may be positioned with respect to rods 920-950 to not interfere with formation of ridges.

Wire 910 joins portion 102, portion 104, and portion 106 so that a force may be applied to portion 102, 104, and/or 106 without separating portion 102, 104, and/or 106 from each other. Joining portion 106 and ribbon 310 permits portion 102 and/or 104 to operate as handles to extract structure 900 from a barrel without separating portions 102, 104, and/or 106 from each other as discussed above.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open-ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. An apparatus for removing paint from a barrel of a provided paintball gun, the apparatus comprising:
- a core having a proximate end portion and a distal end portion;
- a first ridge;
- a second ridge; and
- a cover; wherein:
  - the first ridge mechanically couples to the core in a spiral pattern along the length of the core from the proximate end portion to the distal end portion;
  - the second ridge mechanically couples to the core in the spiral pattern along the length of the core from the proximate end portion to the distal end portion;
  - the first ridge is spaced apart from the second ridge thereby forming a valley between the first ridge and the second ridge along the length of the core from the proximate end portion to the distal end portion; and
  - the cover covers at least a portion of the core, the first ridge, the second ridge, and the valley along the length of the core.

2. The apparatus of claim 1 wherein the first ridge is substantially parallel to the second ridge.

3. The apparatus of claim 1 wherein at least one of the first ridge and the second ridge comprises compressible foam.

4. The apparatus of claim 1 wherein the cover absorbs at least a portion of the paint for transport out of the barrel.

5. The apparatus of claim 1 wherein the core comprises a hollow tube.

6. The apparatus of claim 1 further comprises a strap, wherein the strap couples to the distal end portion of the core, the strap for extracting the apparatus from the barrel of the paintball gun.

7. The apparatus of claim 6 wherein the strap comprises a wire.

8. The apparatus of claim 1 further comprises a strap and the core comprises a hollow tube, wherein:
- the strap couples to the distal portion of the core;
- the strap extends from the distal end portion along an interior of the core and out the proximate end portion; and
- the strap for extracting the apparatus from the barrel of the paintball gun.

9. The apparatus of claim 1 wherein:
- the core comprises an axis along the length of the core; and
- the first ridge is spaced apart angularly from the second ridge around the axis.

10. An apparatus for removing paint from a barrel of a provided paintball gun, the apparatus comprising:
- a first removal device;
- a second removal device;
- a joint mechanically coupled to a proximate end portion of the first removal device and a proximate end portion of the second removal device; and
- a strap that mechanically couples a distal end portion of the first removal device to a distal end portion of the second removal device via the joint; wherein the first removal device and the second removal device each respectively comprise:
  - a core;
  - a first ridge;
  - a second ridge; and
  - a cover; wherein:
    - the first ridge mechanically couples to the core;
    - the second ridge mechanically couples to the core;
    - the first ridge is spaced apart from the second ridge thereby forming a valley between the first ridge and the second ridge;
    - the cover covers at least a portion of the core, the first ridge, the second ridge and the valley.

11. The apparatus of claim 10 wherein the strap comprises a wire.

12. The apparatus of claim 10 wherein the core comprises a hollow tube.

13. The apparatus of claim 12 wherein the strap extends from the distal end portion of the first removal device along an interior of the tube of the first removal device to the distal end portion of the second removal device along an interior of the tube of the second removal device.

14. The apparatus of claim 10 wherein the joint is flexible whereby the joint bends to position the first removal device proximate to the second removal device.

15. An apparatus for removing paint from a barrel of a provided paintball gun, the apparatus comprising:
- a first removal device;
- a second removal device;
- a joint mechanically coupled to a proximate end portion of the first removal device and a proximate end portion of the second removal device; and
- a strap that mechanically couples to a distal end portion of the first removal device and a distal end portion of the second removal device; wherein:
  - the first removal device and the second removal device each respectively comprise:
    - a hollow tube;
    - a first ridge mechanically coupled to the exterior of the tube; and
    - a second ridge mechanically coupled to the exterior of the tube, the second ridge spaced apart from the first ridge thereby forming a valley between the first ridge and the second ridge; and the strap extends from the distal end portion of the first removal device along an interior of the tube of the first removal device to the distal end portion of the second removal device along an interior of the tube of the second removal device.

16. The apparatus of claim 15 wherein the strap comprises a wire.

17. The apparatus of claim 15 wherein the joint is flexible whereby the joint bends to position the first removal device proximate to the second removal device.

18. The apparatus of claim 15 wherein at least one of the first ridge and the second ridge comprises compressible foam.

19. The apparatus of claim 15 wherein the first ridge and the second ridge are mechanically coupled to the tube in a spiral pattern.

20. The apparatus of claim 15 wherein the first ridge is substantially parallel to the second ridge.

* * * * *